US012448981B2

(12) United States Patent
Moreno et al.

(10) Patent No.: US 12,448,981 B2
(45) Date of Patent: Oct. 21, 2025

(54) ELECTRONICALLY COMMUTATED FLUID PUMP INCLUDING AN INTEGRATED CONTROLLER ASSEMBLY HAVING A SEALING ARRANGEMENT

(71) Applicant: PHINIA Jersey Holdings LLC, Wilmington, DE (US)

(72) Inventors: Alejandro Moreno, El Paso, TX (US); Aldo Darien Venegas Carrillo, Ciudad Juarez (MX)

(73) Assignee: PHINIA Jersey Holdings LLC, Wilmington, DE (US)

( * ) Notice: Subject to any disclaimer, the term of this patent is extended or adjusted under 35 U.S.C. 154(b) by 130 days.

(21) Appl. No.: 18/394,148

(22) Filed: Dec. 22, 2023

(65) Prior Publication Data

US 2025/0207604 A1 Jun. 26, 2025

(51) Int. Cl.
*F04D 29/08* (2006.01)
*F04D 29/58* (2006.01)

(52) U.S. Cl.
CPC ..... *F04D 29/086* (2013.01); *F04D 29/5813* (2013.01)

(58) Field of Classification Search
CPC ..... G06F 1/20; F28D 2021/0029; F01P 2011/0233; F04D 29/086; F04D 29/5813
See application file for complete search history.

(56) References Cited

U.S. PATENT DOCUMENTS 6,105,669 A 8/2000 Davis

FOREIGN PATENT DOCUMENTS

JP 6353315 B2 7/2018

OTHER PUBLICATIONS

The International Search Report of the International Searching Authority for Application No. PCT/US2024/060512, dated Mar. 18, 2025 (3 pages).

*Primary Examiner* — Anthony Ayala Delgado
(74) *Attorney, Agent, or Firm* — WARNER NORCROSS + JUDD LLP

(57) ABSTRACT

A sealing arrangement for an electronically commutated fluid pump is provided. The sealing arrangement includes a gland formed in a housing outer face surface and connected to an endless groove in the housing. The gland includes a vent passage and a sealing surface that defines a depression in the outer face surface. The vent passage connects an internal chamber of the housing in fluid communication with the depression. A gasket including a venting element is received in the endless groove such that the venting element is disposed in the gland. The venting element is movable between a closed position in which a lip seals against the sealing surface and an open position in which the lip is spaced from the sealing surface allowing communication of fluid from the housing chamber to the outside. An integrated controller assembly and fluid pump including the sealing arrangement are also provided.

20 Claims, 14 Drawing Sheets

ELECTRONICALLY COMMUTATED FLUID PUMP INCLUDING AN INTEGRATED CONTROLLER ASSEMBLY HAVING A SEALING ARRANGEMENT

FIELD OF THE INVENTION

The disclosure generally relates to electronically commutated fluid pumps and, more specifically, to electronically commutated fluid pumps for pumping fluids such as oil or fuel.

BACKGROUND OF THE INVENTION

Electro-hydraulic pumps are electromechanical apparatuses in which mechanical energy generated by a motor is transferred to a hydraulic pump section that moves a fluid to provide fluid flow and fluid pressure in a hydraulic circuit. Examples of these pumps used in vehicles include gear pumps such as electronic fuel pumps (EFPs) that feed fuel from the fuel delivery module (FDM) in the fuel tank to a combustion engine of the vehicle. Other examples include electronic oil pumps that move hydraulic fluid to cool and lubricate the internal mechanisms of, for example, an integrated drive module (IDM), such as the drive motor and gear box of the IDM. These electronic pumps may be directly commutated ("brush") pumps that are driven by a constant voltage signal or electronically commutated ("brushless") pumps that are driven by dedicated pump controllers. Common electronically commutated pumps include a housing assembly that houses the electric motor and a pumping section such as a gerotor arrangement that is driven by the motor. A controller operates the motor to drive the pumping section to pump fluid from a reservoir to a desired vehicle system.

The use of electronically commutated pumps in the field of automotive vehicles has increased with the demand for greater vehicle fuel economy as well as greater drive range for electric vehicles (EVs). This demand requires that the pumps and systems that use them are more robust and efficient, while also offering these improvements at a lower cost. For example, the use of electronically commutated requires the pump controller to either be integrated into an existing control module (e.g., the engine control module (ECM), the powertrain control module (PCM), or the vehicle control module (VCM)), located in a separate standalone unit external to the pump or other control modules, or integrated directly into the pump. Configurations in which the controller is exposed to environmental elements and temperatures are challenging in regards to maintaining the useful life of the controller. Road or drive train vibration, extreme hot and cold environmental temperatures, thermal shock, humidity, high pressure, salt spray, and gravel bombardment are some of the hazards that are posed to controllers that are disposed under the vehicle hood or in other external carriage locations. As such, the sealing and venting of printed circuit board (PCB) controllers and related electronics is critical to ensuring proper pump life and function. Sealing of a PCB chamber in a controller assembly is typically accomplished with paper, rubber, or liquid silicon gaskets that are placed in position during assembly. The PCB chamber in the PCB assembly needs to be vented to account for changes in pressure due to gas build up (outgassing) from and around the electronic components. Passive ventilation uses non-mechanical design elements, such as ventilation holes cut into the chamber enclosure, to cool the PCB device, equalize pressure, and prevent condensation. Passive ventilation is typically used for ventilating smaller device enclosures having lower input power. Other ventilation systems include a ventilation hole that is covered with a plastic sticker after the PCB cavity has been relieved of any pressure that is built up, typically by energizing the PCB during assembly and testing to remove any gases trapped in the PCB cavity before the hole is closed and sealed. Once the hole is closed by the sticker or similar, the hole is sealed and prevents flow of gas. The lack of robustness of a hole covered by a sticker limits its use in harsh environmental conditions, and alternatively adding extra components to the ventilation system can be cost-prohibitive. Thus, proper ventilation of PCB chambers represents a potential cost increase in both product material and the assembly process. Therefore, a need exists for a PCB ventilation system that does not add additional elements or assembly steps to the system and that can withstand the environmental conditions experienced by a vehicle and its components. This is especially true for electronically commutated fluid pumps in which the controller is integrated into the pump.

BRIEF SUMMARY

An improved sealing arrangement for an electronically commutated fluid pump is provided. The sealing arrangement includes a housing including an outer face surface and an internal chamber. The outer face surface forms a perimeter that defines an opening into the chamber. An endless groove is formed in the outer face surface. The endless groove surrounds the perimeter and has an inward radial sealing surface, an opposite outward radial sealing surface, and a bottom axial sealing surface between the inward and outward radial sealing surfaces. A gland is formed in the outer face surface and is connected to the endless groove. The gland includes a vent passage and a sealing surface that defines a depression in the outer face surface of the housing. The vent passage connects the chamber in fluid communication with the depression. The sealing arrangement further includes a gasket including an endless body having an inner side surface, an outer side surface, a bottom surface, a top surface, a pair of inner and outer radially extending wings, and a venting element. The inner wing extends from the inner side surface of the body and the outer wing extends from the outer side surface of the body. The venting element protrudes from the outer side surface of the body and includes a lip. The lip extends upwardly and outwardly from the bottom surface of the body. The gasket is received in the endless groove such that the venting element is disposed in the gland, the inner wing of the gasket engages the inward radial sealing surface of the endless groove, and the outer wing of the gasket engages the outward radial sealing surface of the endless groove. The venting element is movable between a closed position in which the lip of the venting element seals against the sealing surface of the gland and an open position in which the lip is spaced from the sealing surface to allow for communication of fluid from the housing chamber to outside of the housing. The venting element is in the closed position when an external pressure outside of the housing is greater than an internal pressure in the housing chamber, and the venting element is in the open position when the internal pressure in the housing chamber is greater than the external pressure outside of the housing.

In specific embodiments, the vent passage is a groove transverse to the endless groove.

In particular embodiments, the vent passage groove extends from a wall of the chamber housing through the endless groove to the sealing surface of the gland.

In particular embodiments, the vent passage groove is formed in the outer face surface of the housing, the endless groove, and the sealing surface.

In specific embodiments, the venting element includes a pair of sidewalls disposed at opposite ends of the lip.

In particular embodiments, a pocket is formed between the lip of the venting element, the sidewalls of the venting element, and the outer side surface of the body.

In specific embodiments, the venting element includes at least one rib formed on a back surface of the lip.

In specific embodiments, the inner wing of the gasket has a break adjacent the venting element, and the break is aligned with the vent passage of the gland.

An integrated controller assembly for an electronically commutated fluid pump is also provided. The integrated controller assembly includes a housing including an outer face surface and an internal chamber. The outer face surface forms a perimeter that defines an opening into the chamber. A printed circuit board is received in the chamber. Electrical terminals are connected to the printed circuit board and extend through the housing. A heat sink is mounted against the outer face surface of the housing and covers the opening in the housing. An endless groove is formed in the outer face surface of the housing. The endless groove surrounds the perimeter and has an inward radial sealing surface, an opposite outward radial sealing surface, and a bottom axial sealing surface between the inward and outward radial sealing surfaces. A gland is formed in the outer face surface and is connected to the endless groove. The gland includes a vent passage and a sealing surface that defines a depression in the outer face surface of the housing. The vent passage connects the chamber in fluid communication with the depression. The assembly further includes a gasket including an endless body having an inner side surface, an outer side surface, a bottom surface, a top surface, a pair of inner and outer radially extending wings, and a venting element. The inner wing extends from the inner side surface of the body and the outer wing extends from the outer side surface of the body. The venting element protrudes from the outer side surface of the body and includes a lip. The lip extends upwardly and outwardly from the bottom surface of the body. The gasket is received in the endless groove such that the venting element is disposed in the gland, the inner wing of the gasket engages the inward radial sealing surface of the endless groove, the outer wing of the gasket engages the outward radial sealing surface of the endless groove, and the top surface of the gasket engages the heat sink. The venting element is movable between a closed position in which the lip of the venting element seals against the sealing surface of the gland and an open position in which the lip is spaced from the sealing surface to allow for communication of fluid from the housing chamber to outside of the housing. The venting element is in the closed position when an external pressure outside of the housing is greater than an internal pressure in the housing chamber, and the venting element is in the open position when the internal pressure in the housing chamber is greater than the external pressure outside of the housing.

In specific embodiments, the vent passage is a groove transverse to the endless groove.

In specific embodiments, the venting element includes a pair of sidewalls disposed at opposite ends of the lip.

In particular embodiments, a pocket is formed between the lip of the venting element, the sidewalls of the venting element, and the outer side surface of the body.

In specific embodiments, the inner wing of the gasket has a break adjacent the venting element, and the break is aligned with the vent passage of the gland.

An electronically commutated fluid pump is also provided. The fluid pump includes a main housing, a pumping section disposed within the main housing, a motor disposed within the main housing and operatively connected to the pumping section, and an integrated controller assembly mounted on the main housing. The integrated controller assembly includes a housing including an outer face surface and an internal chamber. The outer face surface forms a perimeter that defines an opening into the chamber. A printed circuit board is received in the chamber. Electrical terminals are connected to the printed circuit board and extend through the housing. A heat sink is mounted against the outer face surface of the housing and covers the opening in the housing. An endless groove is formed in the outer face surface of the housing. The endless groove surrounds the perimeter and has an inward radial sealing surface, an opposite outward radial sealing surface, and a bottom axial sealing surface between the inward and outward radial sealing surfaces. A gland is formed in the outer face surface and is connected to the endless groove. The gland includes a vent passage and a sealing surface that defines a depression in the outer face surface of the housing. The vent passage connects the chamber in fluid communication with the depression. The assembly further includes a gasket including an endless body having an inner side surface, an outer side surface, a bottom surface, a top surface, a pair of inner and outer radially extending wings, and a venting element. The inner wing extends from the inner side surface of the body and the outer wing extends from the outer side surface of the body. The venting element protrudes from the outer side surface of the body and includes a lip. The lip extends upwardly and outwardly from the bottom surface of the body. The gasket is received in the endless groove such that the venting element is disposed in the gland, the inner wing of the gasket engages the inward radial sealing surface of the endless groove, the outer wing of the gasket engages the outward radial sealing surface of the endless groove, and the top surface of the gasket engages the heat sink. The venting element is movable between a closed position in which the lip of the venting element seals against the sealing surface of the gland and an open position in which the lip is spaced from the sealing surface to allow for communication of fluid from the housing chamber to outside of the housing. The venting element is in the closed position when an external pressure outside of the housing is greater than an internal pressure in the housing chamber, and the venting element is in the open position when the internal pressure in the housing chamber is greater than the external pressure outside of the housing.

In specific embodiments, the vent passage is a groove transverse to the endless groove.

In particular embodiments, the vent passage groove extends from a wall of the chamber housing through the endless groove to the sealing surface of the gland.

In particular embodiments, the vent passage groove is formed in the outer face surface of the housing, the endless groove, and the sealing surface.

In specific embodiments, the venting element includes a pair of sidewalls disposed at opposite ends of the lip.

In specific embodiments, a pocket is formed between the lip of the venting element, the sidewalls of the venting element, and the outer side surface of the body.

In specific embodiments, the inner wing of the gasket has a break adjacent the venting element, and the break is aligned with the vent passage of the gland.

DESCRIPTION OF THE DRAWINGS

Various advantages and aspects of this disclosure may be understood in view of the following detailed description when considered in connection with the accompanying drawings, wherein.

DETAILED DESCRIPTION OF THE INVENTION

An electronically commutated fluid pump is provided. Referring to FIGS. 1-18, wherein like numerals indicate corresponding parts throughout the several views, the electronically commutated fluid pump (also referred to as the fluid pump herein) is illustrated and generally designated as an oil pump 10 for pumping liquid oil from a reservoir 12 to an integrated drive module (IDM) of an electric or hybrid vehicle to cool and lubricate the internal working mechanisms of the IDM including the IDM drive motor 13 and gear box 14. While the fluid pump is illustrated as oil pump 10 for an IDM, it should be understood that the invention is not limited to an oil pump, but could also be applied to fluid pumps for pumping fluids other than oil, such as but not limited to fuel, and in other applications other than for an IDM. The oil pump 10 provides for improved ventilation of an integrated controller assembly by incorporating venting features into existing sealing components of the pump without the need for additional venting components or added assembly steps and associated costs. Certain features of the oil pump 10 are functional, but can be implemented in different aesthetic configurations.

Figure 1:
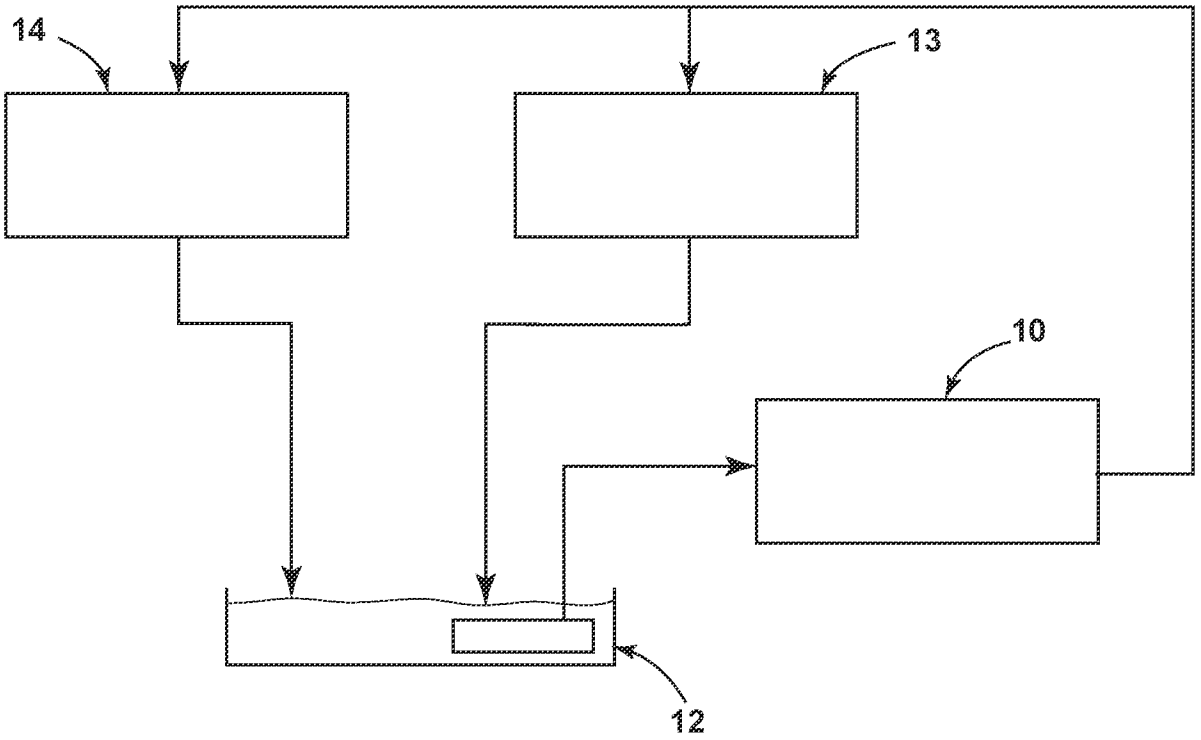
FIG. 1 is a schematic view of an integrated drive module including an electronically commutated fluid pump in accordance with embodiments of the disclosure.
Figure 2:
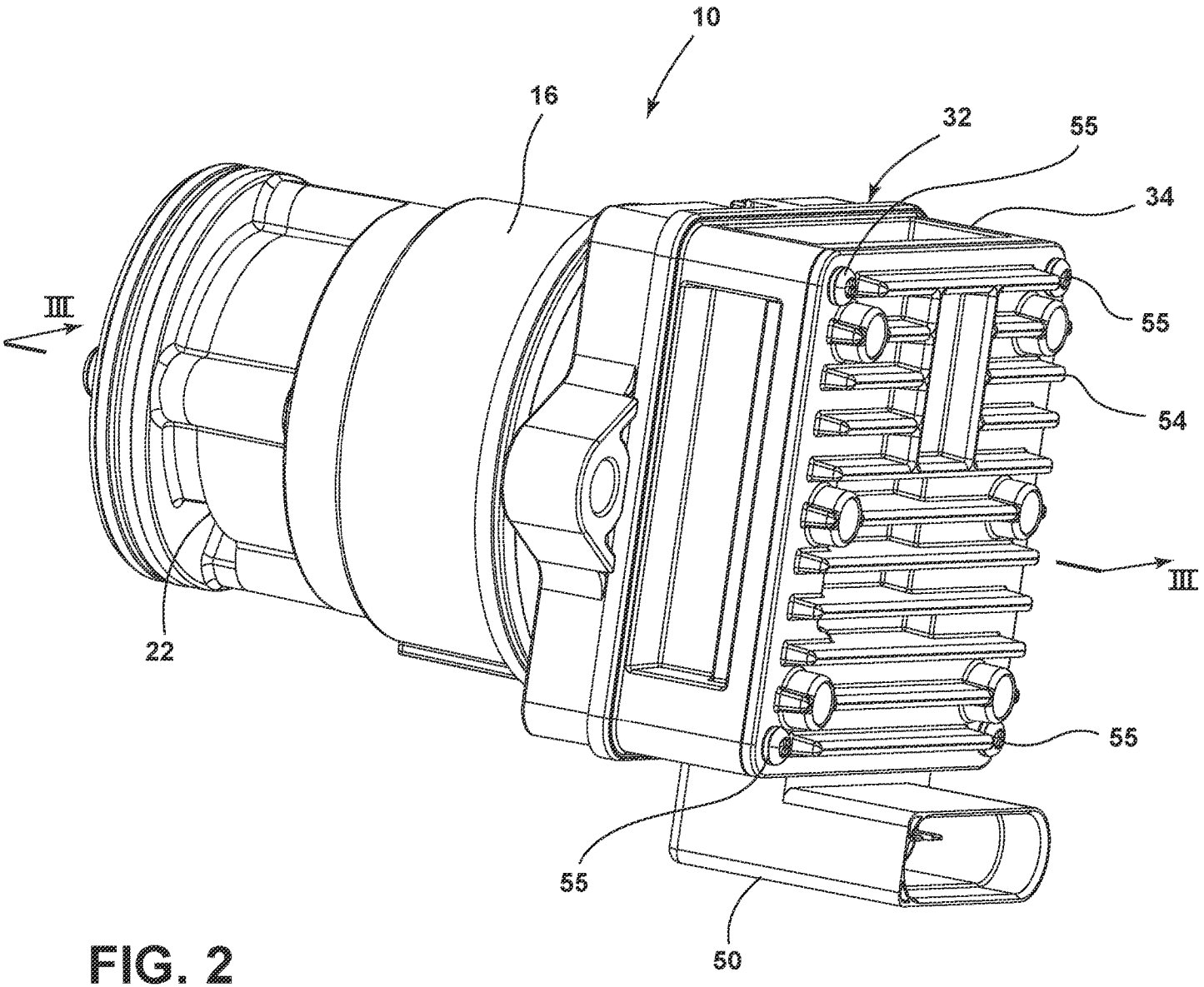
FIG. 2 is a perspective view of an electronically commutated fluid pump in accordance with some embodiments of the disclosure.
Figure 3:
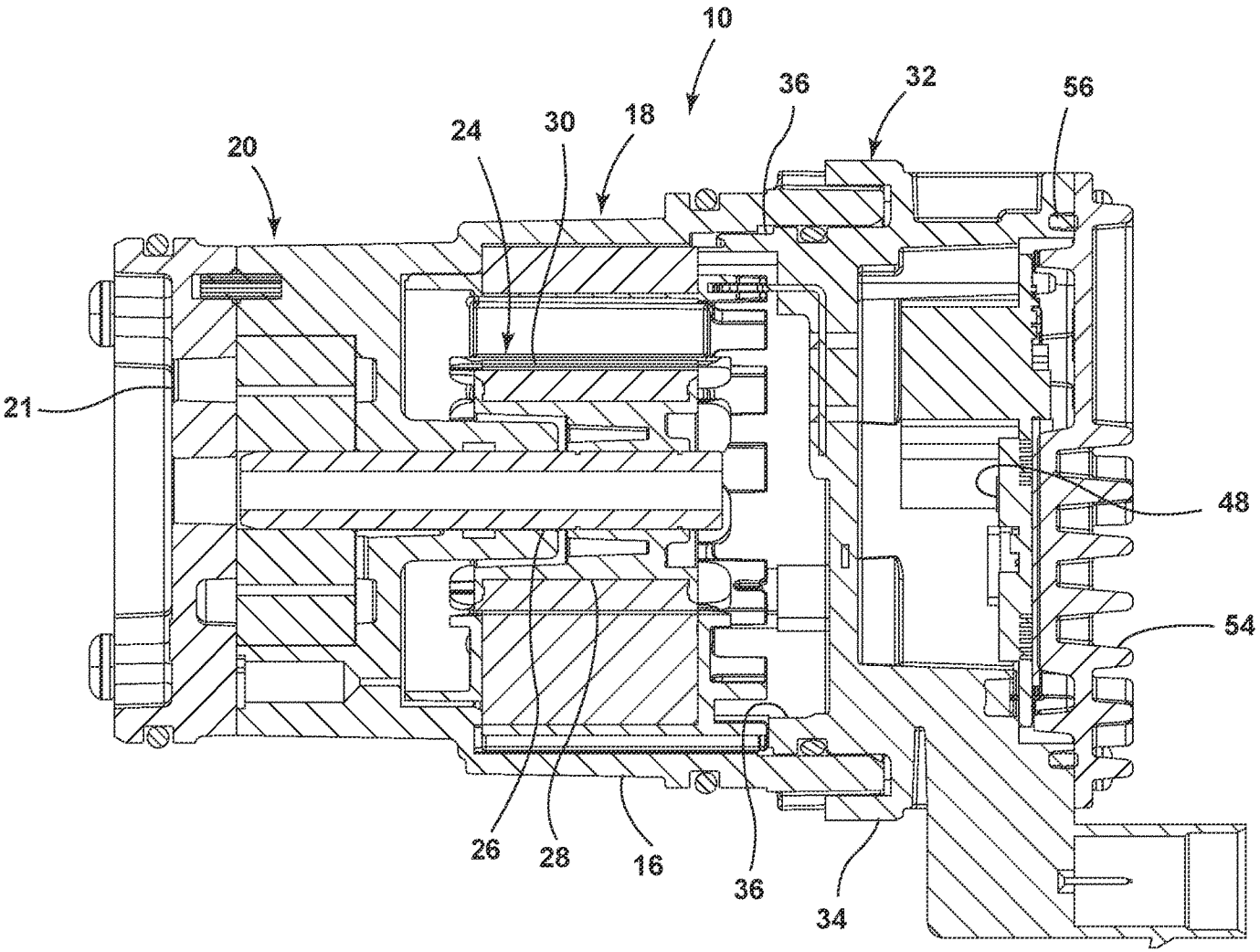
FIG. 3 is a cross-sectional view of the electronically commutated fluid pump of FIG. 2 taken along the line III-III.

With reference to FIGS. 2 and 3, the oil pump 10 generally includes a main housing 16 within which a motor section 18 and an adjacent pumping section 20 are disposed and retained. Low pressure oil enters oil pump 10 at the pumping section 20 via an inlet 21. A portion of the pumping section 20 is rotated by the motor section 18, and oil is pumped out of the pumping section 20 via an outlet 22 at a higher pressure than the inlet pressure.

The motor section 18 includes an electric motor 24 which is disposed within the main housing 16. The electric motor 24 is, for example, an electronically commutated (EC) brushless motor. Electric motor 24 includes a shaft 26 extending therefrom into the pumping section 20. The motor 24 is thereby operatively connected to the pumping section 20. A permanent magnet rotor 28 is attached at an opposite end of the shaft 26, and the rotor 28 is surrounded by a stator 30. Shaft 26 rotates when an electric current is applied to the stator 30 of the electric motor 24. Electric motors, pumping sections, and their operation are well known, consequently, electric motor 24 and pumping section 20 will not be discussed further herein.

Figure 4:
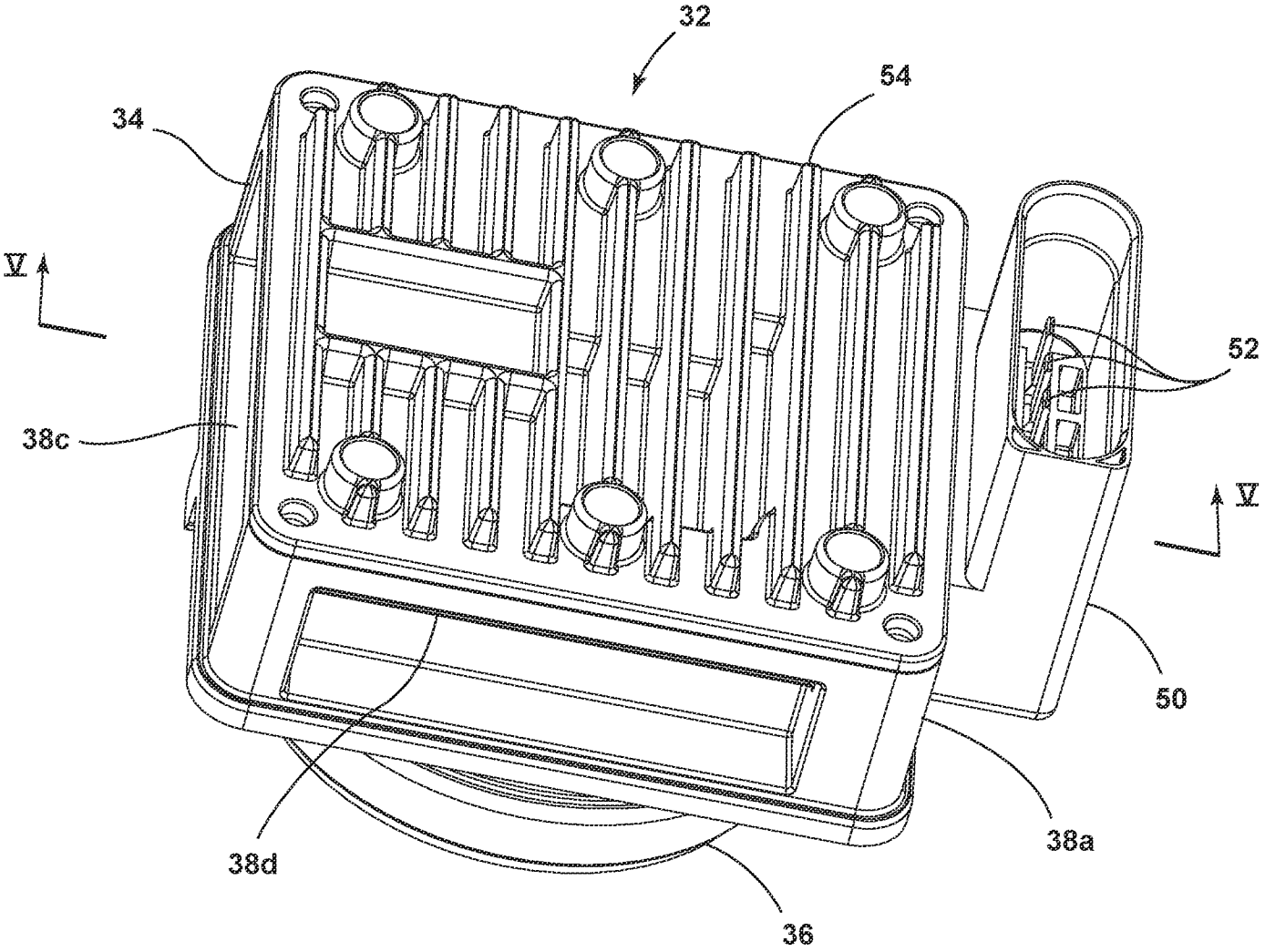
FIG. 4 is a perspective view of an integrated controller assembly of the electronically commutated fluid pump of FIG. 2.
Figure 5:
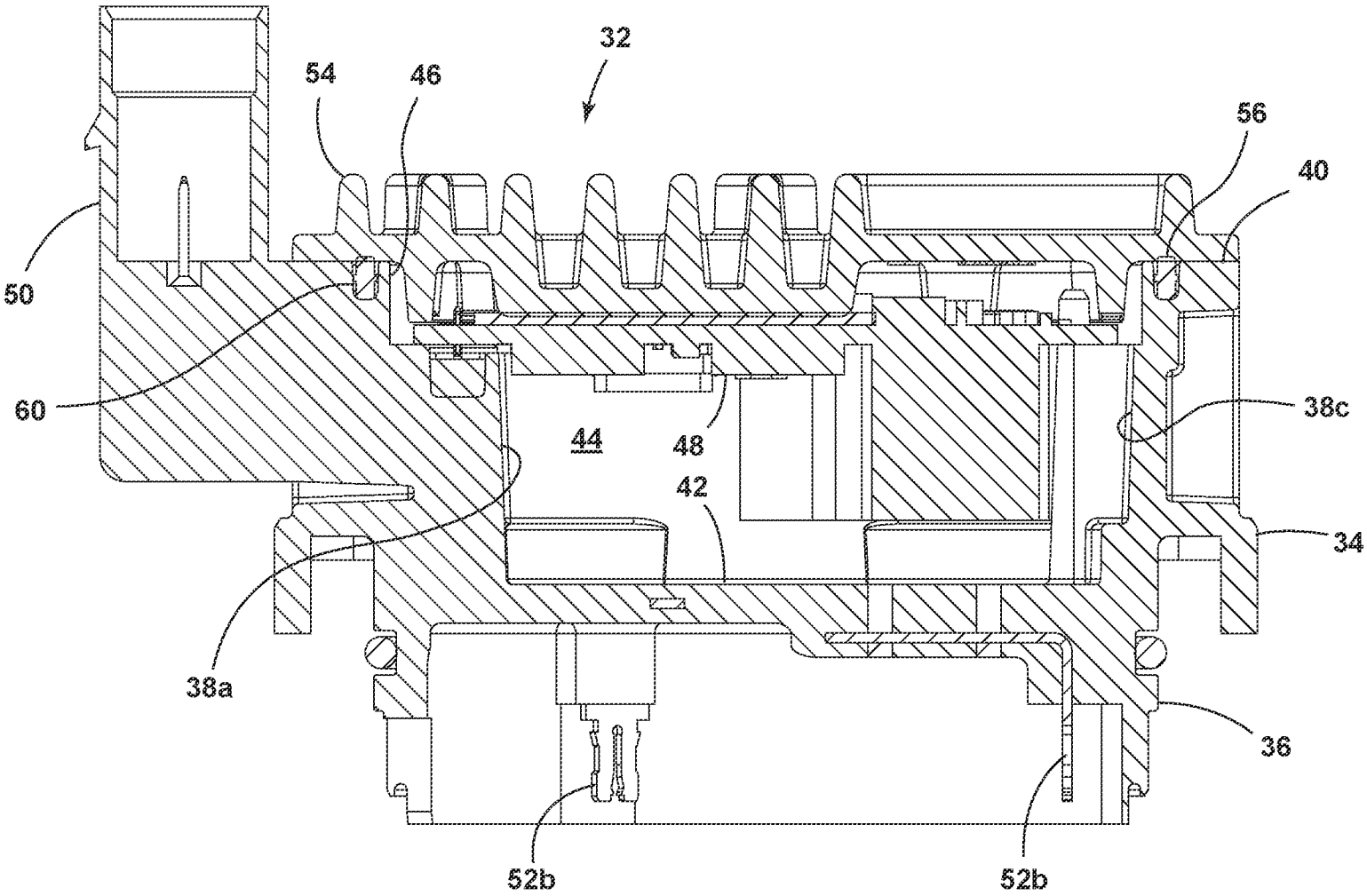
FIG. 5 is a cross-sectional view of the integrated controller assembly of FIG. 4 taken along the line V-V.
Figure 6:
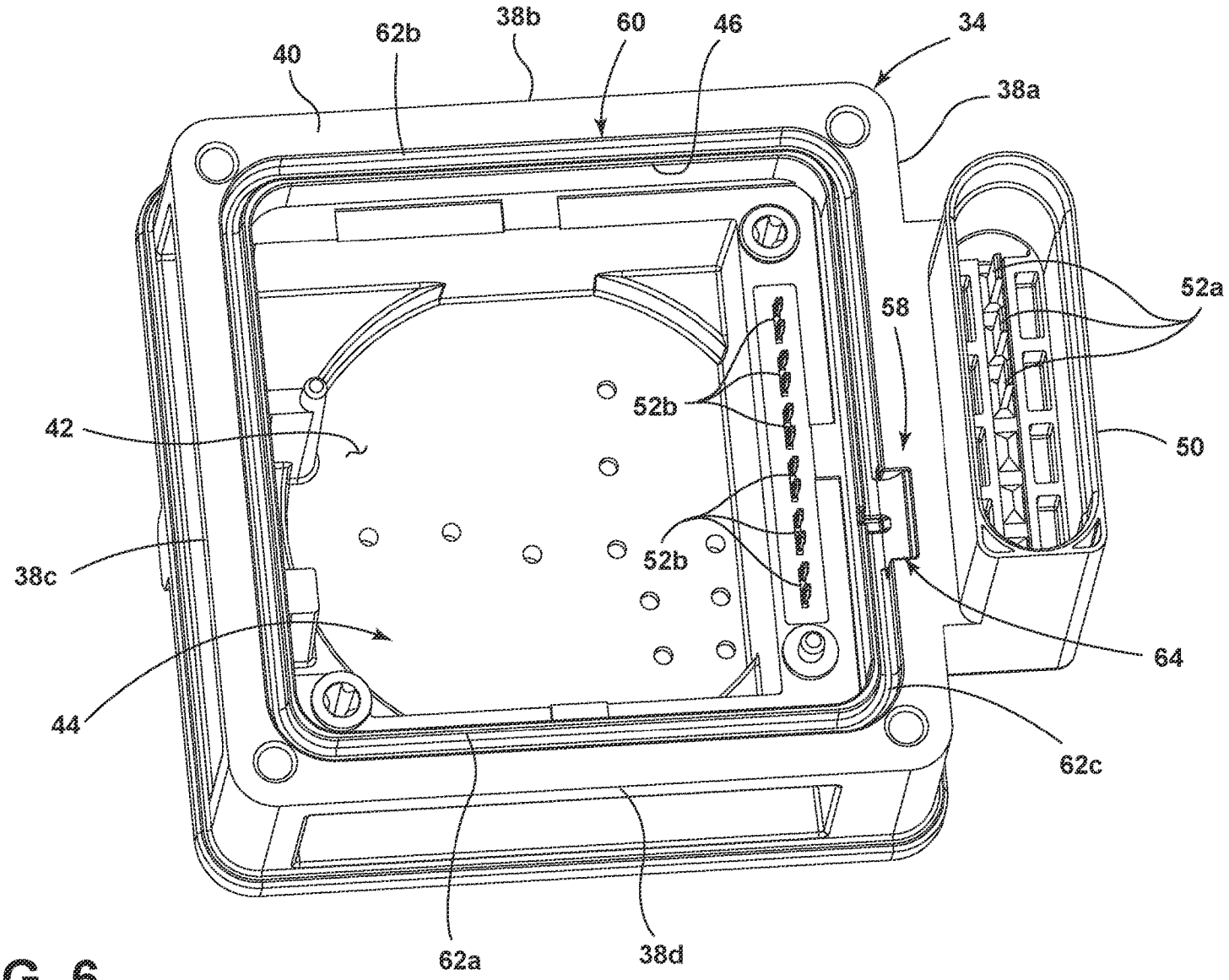
FIG. 6 is a perspective view of a housing of the integrated controller assembly.
Figure 7:
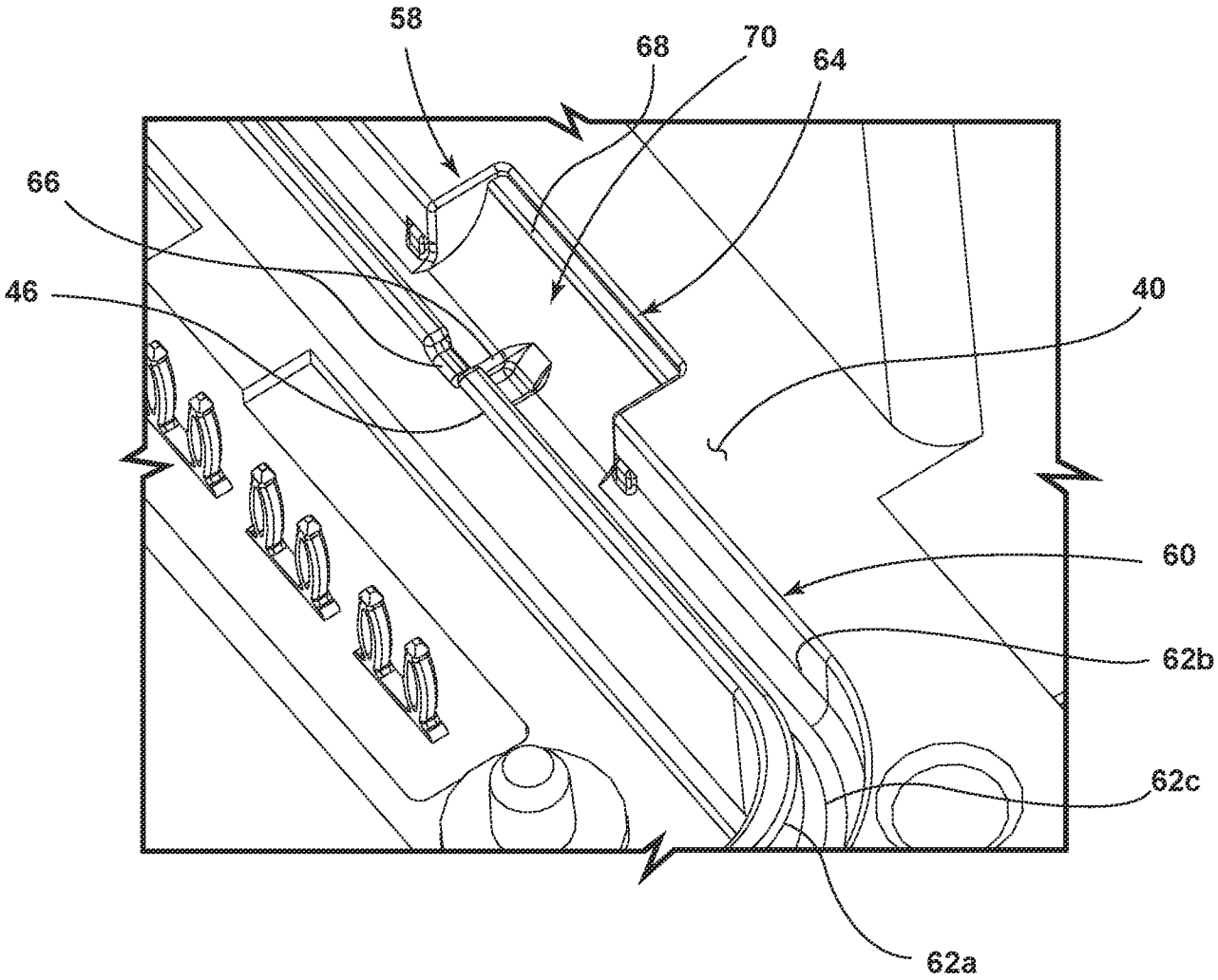
FIG. 7 is an enlarged perspective view of a portion of the housing of the integrated controller assembly of FIG. 6 illustrating a gland of a sealing arrangement in accordance with some embodiments of the disclosure.
Figure 8:
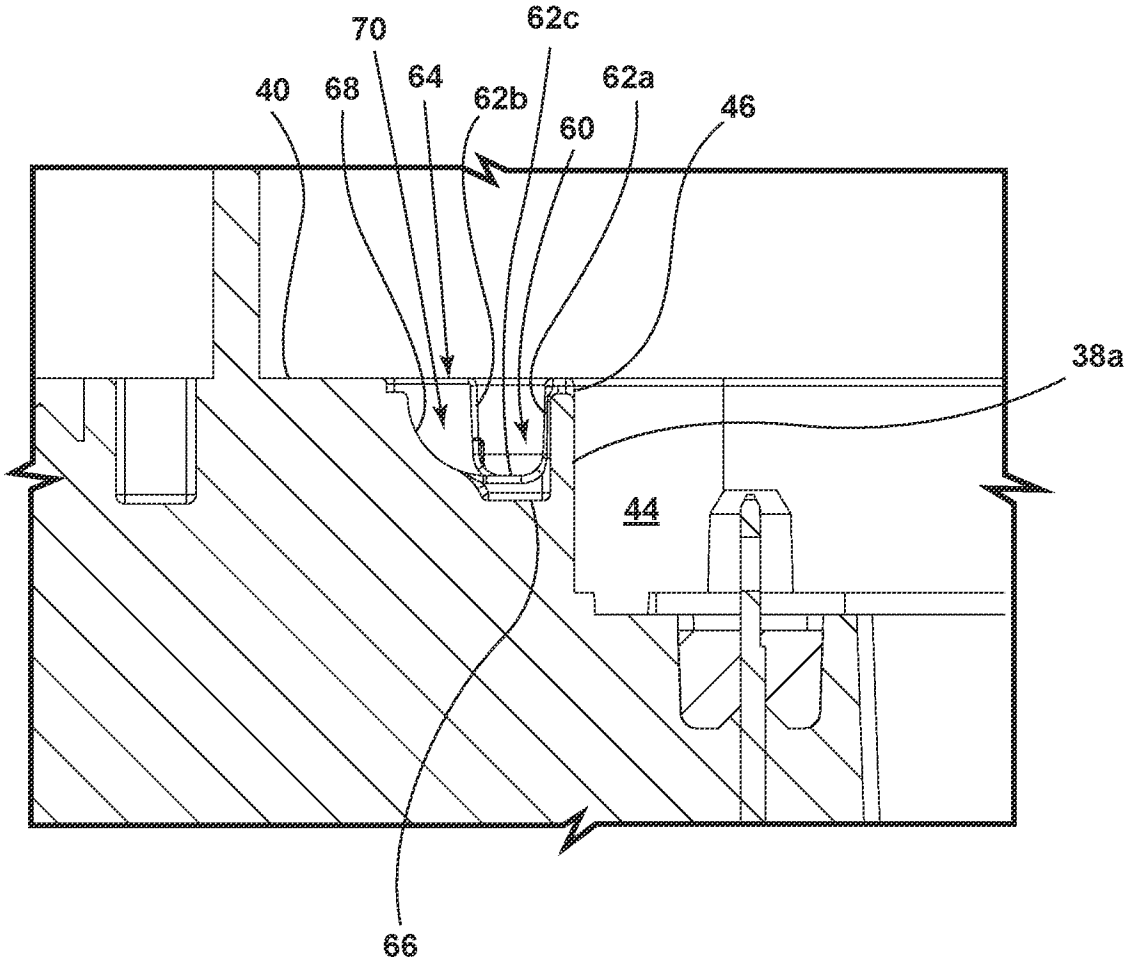
FIG. 8 is an enlarged cross-sectional view of a portion of the housing of the integrated controller assembly of FIG. 6.
Figure 9:
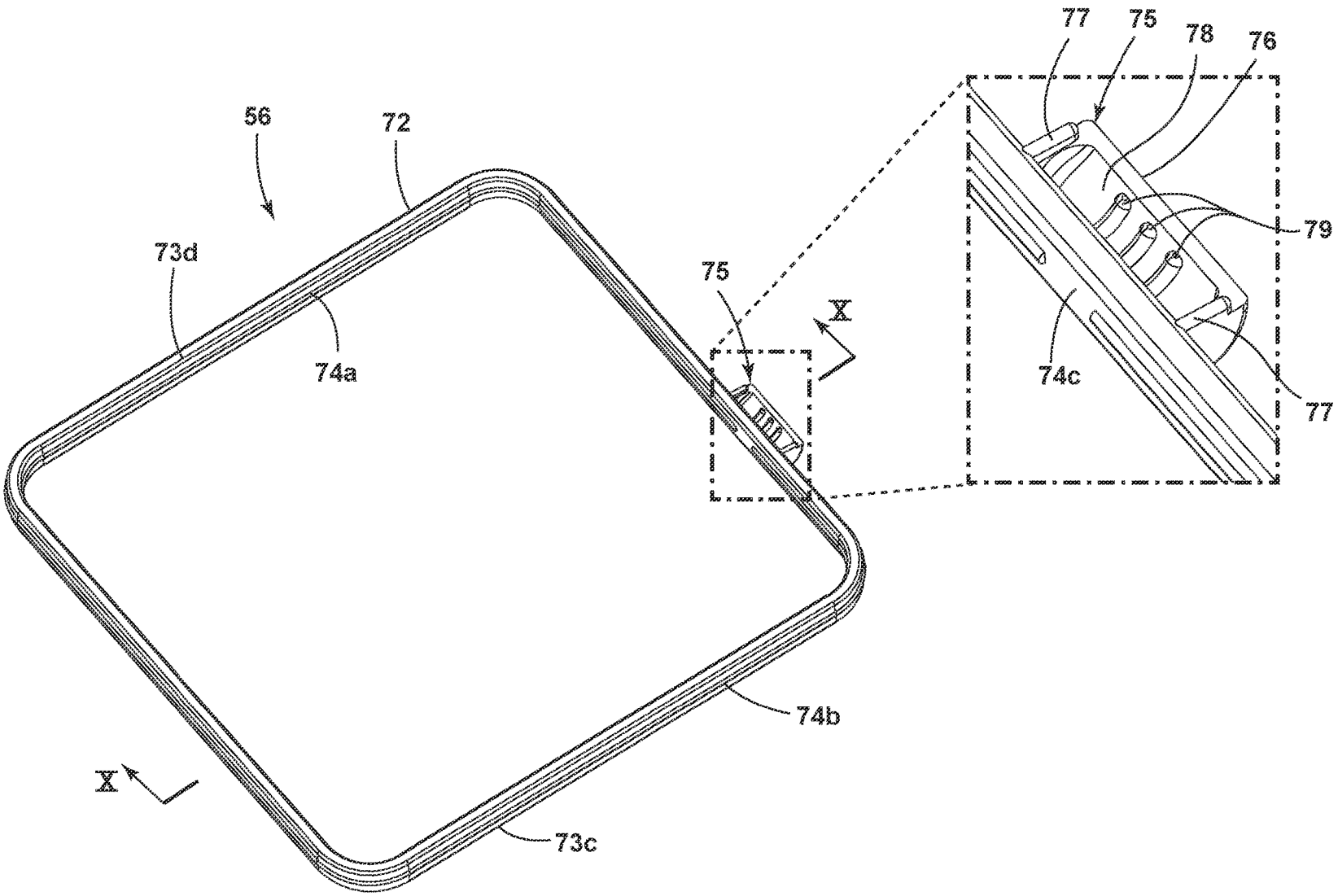
FIG. 9 is a perspective view of a gasket of the sealing arrangement in accordance with some embodiments of the disclosure.
Figure 10:
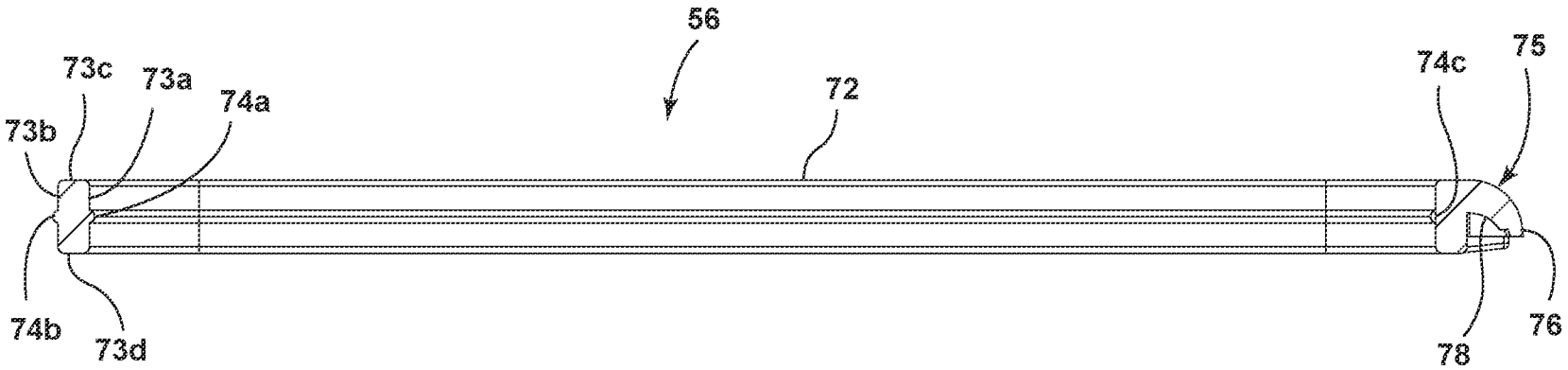
FIG. 10 is a cross-sectional view of the gasket of FIG. 9 taken along the line X-X.
Figure 11:
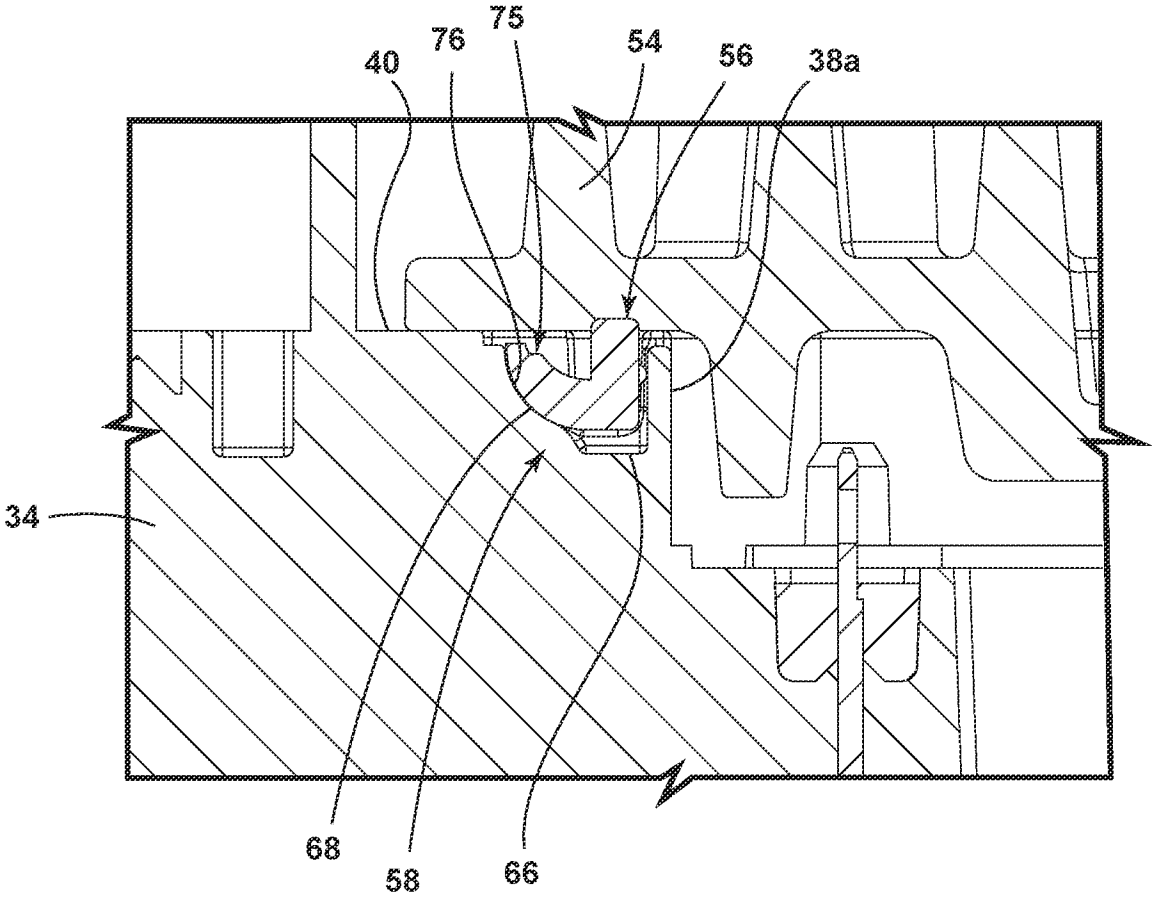
FIG. 11 is an enlarged cross-sectional view of the sealing arrangement.

With continued reference to FIGS. 2-3 and further reference to FIGS. 4-6, an integrated controller assembly 32 is mounted on the main housing 16 adjacent the motor section 18 and closes an end of the main housing 16 at the motor section 18. The integrated controller assembly 32 generally includes a housing (sub-housing) 34. The housing 34 includes a cylindrical endcap 36 that seals the main housing 16. A set of connected sidewalls 38*a*, 38*b*, 38*c*, 38*d* extend from the endcap 36 and terminate in an outer face surface 40. The sidewalls 38*a-d* together with a floor 42 define an internal chamber 44 within the housing 34. The outer face surface 40 forms a perimeter around the outer ends of the sidewalls. The perimeter defines an opening 46 into the internal chamber 44. A controller in the form of a printed circuit board (PCB) 48 is received and retained within the internal chamber 44. A wire harness connector 50 extends outwardly from one of the sidewalls 38*a*, and a plurality of electrical terminals 52*a* extend from the wire harness connector 50 through the housing 34 and are connected to the PCB 48. The wire harness connector 50 can be connected to a wire harness (not shown) that, for example, supplies power and/or communicates electrical signals to and/or from the PCB 48. A plurality of electrical terminals 52*b* extend from the PCB 48 through the housing 34 into the endcap 36. The electrical terminals 52*b* connect the PCB 48 to the electric motor 24 so that the PCB 48 can control the motor 24. A heat sink 54 is mounted against the outer face surface 40 of the housing 34 by a plurality of fasteners 55. The heat sink 54 covers the opening 46 and dissipates heat generated by the PCB 48 and motor 24.

In order to seal the internal chamber 44 in which the PCB 48 is located, a gasket 56 is disposed between the interface of the heat sink 54 and the housing 34. However, to release pressure in the sealed chamber 44 due to gas build-up (outgassing) from and around the electronic components of the PCB 48, the housing 34 and gasket 56 of the integrated controller assembly 32 together provide a passive ventilation sealing arrangement 58 that relieves pressure build-up in the chamber 44. With continued reference to FIGS. 5 and 6 and further reference to FIGS. 7-11, the gasket 56 is received and held in an endless groove 60 formed in the outer face surface 40 of the housing 34. The groove 60 surrounds the opening 46 around the perimeter of the outer face surface 40. The groove 60 has an inward radial sealing surface 62*a*, an opposite outward radial sealing surface 62*b*, and a bottom axial sealing surface 62*c* between the inward and outward radial sealing surfaces 62*a*, 62*b*. A gland 64 is formed in the outer face surface 40 of the housing 34 and is connected to the groove 60. The gland 64 is located in the vicinity of the wire harness connector 50, but generally may be located anywhere along the groove 60. The gland 64 includes a vent passage 66 and a sealing surface 68. The sealing surface 68 is recessed in the outer face surface 40, thereby defining an arcuate depression 70 in the outer face surface 40, and extends outwardly from the outward radial sealing surface 62*b* of the groove 60. The length of the sealing surface 68 is less than half the length of the sidewall 38*a* of the housing 34, alternatively less than a quarter of the length of the sidewall 38*a*, alternatively less than one-fifth of the length of the sidewall 38*a*. The width of the sealing surface 68 may be approximately and/or at least half of the width of the outer face surface 40. The vent passage 66 is formed at one end in the outer face surface 40 adjacent the opening 46 to the internal chamber 44, extends vertically along the inward sealing surface 62*a* of the groove 60, across the bottom sealing surface 62*c* of the groove 60, and into the sealing surface 68 of the gland 64. The vent passage 66 thereby forms a groove that perpendicularly traverses the groove 60 and connects the internal chamber 44 in fluid communication with the depression 70 in the outer face surface 40.

The gasket 56 is formed of an endless body 72 having an inner side surface 73*a*, an outer side surface 73*b*, a bottom surface 73*c*, and a top surface 73*d*. The gasket body 72 generally has a rectangular cross-sectional shape, but is not limited to such a cross-section, and the overall shape of the gasket 56 corresponds to the shape of the groove 60 in the outer face surface 40 of the housing 34 so that the gasket 56 can be inserted into the groove 60. For example, both may have a corresponding quadrilateral shape with curved corners. An inner radially extending wing 74*a* extends inwardly from the inner side surface 73*a* of the body 72, and similarly an outer radially extending wing 74*b* extends outwardly from the outer side surface 73*b* of the body 72. The wings 74*a*, 74*b* generally extend continuously around the perimeter of the gasket 56, but there is a break 74*c* in the inner wing 74*a* as described in more detail below. Each of the pair of wings 74*a*, 74*b* are significantly shorter in height than the height of the gasket 56 from the bottom surface 73*c* to the top surface 73*d*, such as less than a quarter of the height of the gasket, alternatively less than one-fifth the height of the gasket, and extend outwardly less than a quarter of the width of the gasket from the inner surface 73*a* to the outer surface 73*b*, alternatively less than one-fifth the width of the gasket, alternatively less than one-sixth the width of the gasket. The wings 74*a*, 74*b* may have an arcuate (e.g., semi-circular) cross-section, or alternatively may have a square, rectangular, or triangular cross-section. The wings 74*a*, 74*b* are generally centered between the bottom surface 73*c* and top surface 73*d* of the gasket 56, but alternatively may be offset from center. A venting element 75 protrudes from the outer side surface 73*b*. The venting element 75 includes a lip 76 that is curved and that extends upwardly and outwardly from the bottom surface 73*c*, and a sidewall 77 at each of the two opposite ends of the curved lip 76. However, it should be understood that the lip may have a combination of a curved and straight shape, or alternatively may have a combination of a straight and angled shape. A curved-shaped lip is only one embodiment of the venting element 75. A pocket 78 is formed between the curved lip 76 of the venting element 75, the sidewalls 77, and the outer side surface 73*b* of the body 72. The pocket 78 aides in the flexing of the curved lip 76 as described in more detail below. At least one rib, in this case three ribs 79, are formed on a back surface of the curved lip 76. The ribs 79 support the curved lip 76 and may control the degree of flexing of the curved lip.

When the gasket 56 is assembled into the groove 60 in the housing outer face surface 40, the venting element 75 fits into the depression 70 of the gland 64. The venting element 75 thereby serves as a locating feature that assures proper orientation of the gasket 56 in the groove 60. The curved lip 76 rests adjacent to the sealing surface 68 of the gland 64 and thus generally corresponds in shape to the sealing surface. Further, the outer edge of the curved lip 76 stops short of reaching the outer face surface 40 and therefore does not extend out of the gland 64. The break 74*c* in the inner wing 74*a* of the gasket 56 is adjacent the gasket venting element 75, and thus in the assembled disposition the break 74*c* is aligned with the vent passage 66 of the gland 64. With the heat sink 54 subsequently mounted on the housing 34, the heat sink 54 engages and compresses the gasket 56 into the groove 56. Thus, the inner wing 74*a* of the gasket 56 engages and provides a radial compression seal against the inward sealing surface 62*a* of the groove 60, the outer wing 74*b* of the gasket 56 engages and provides a radial compression seal against the outward sealing surface 62*b* of the groove 60, and the bottom surface 73*c* of the gasket 56 engages and provides an axial compression seal against the bottom surface 62*b* of the groove 60 to the seal the internal chamber and prevent fluid flow through the interface of the heat sink 54 and housing 34. However, the sealing arrangement 58 formed by the gland 64 and venting element 75 passively allows for both sealing of the internal chamber 44 of the housing 34 and venting of fluid (e.g., gases) when necessary.

Figure 13:
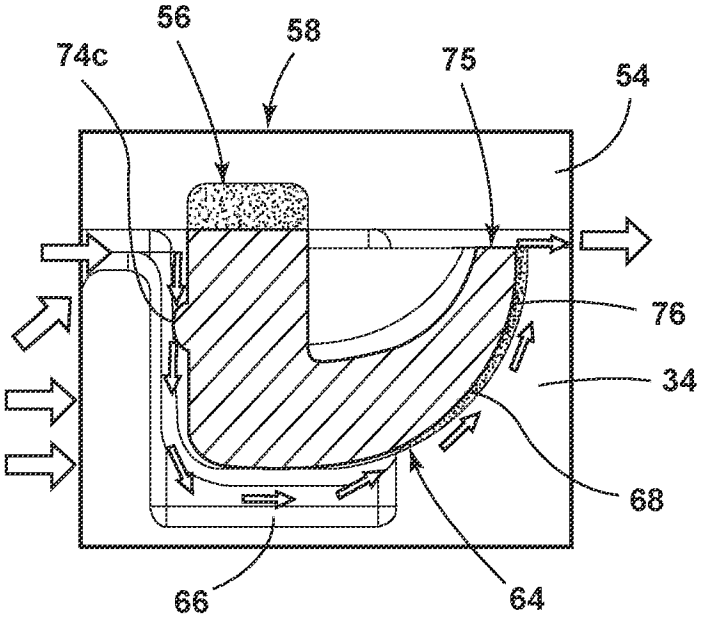
FIG. 13 is a schematic view of the sealing arrangement illustrating the venting element in an open position.
Figure 12:
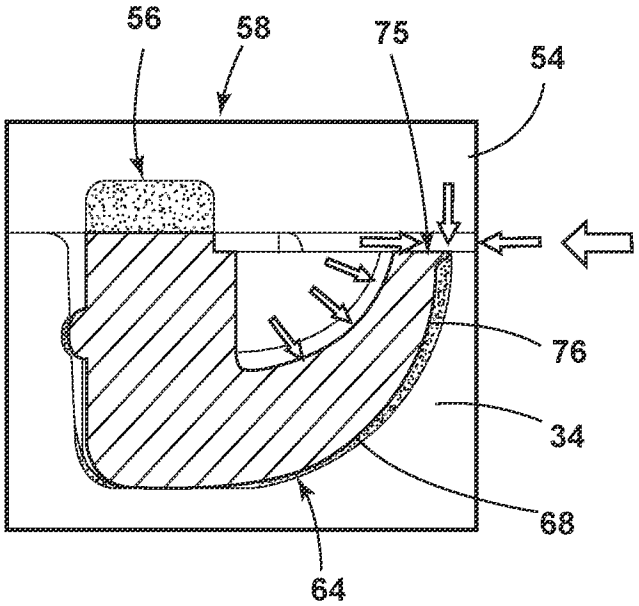
FIG. 12 is a schematic view of the sealing arrangement illustrating a venting element of the sealing arrangement in a closed position.
Figure 14:
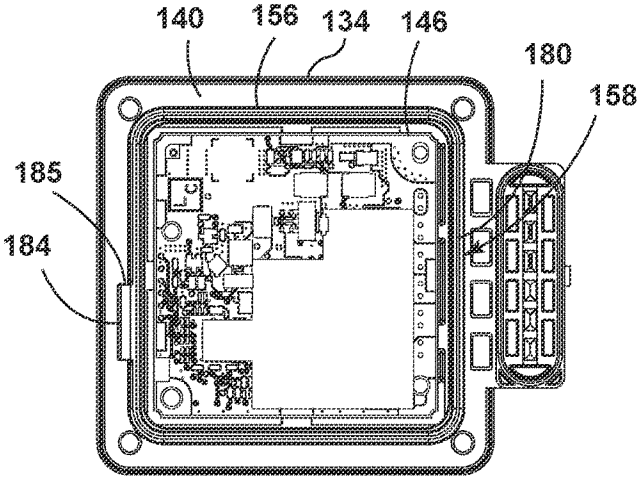
FIG. 14 is a plan view of an integrated controller assembly including a sealing arrangement in accordance with an alternative embodiment of the disclosure, in which the heat sink is removed.
Figure 16:
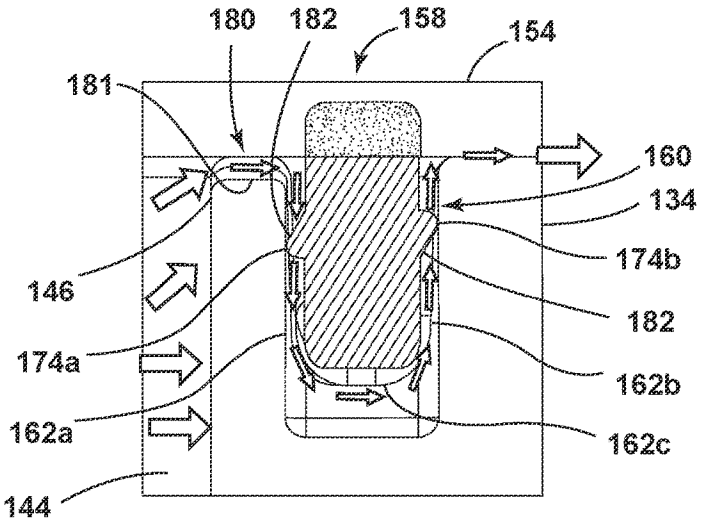
FIG. 16 is a schematic view of the alternative sealing arrangement illustrating the sealing arrangement in an open position.
Figure 15:
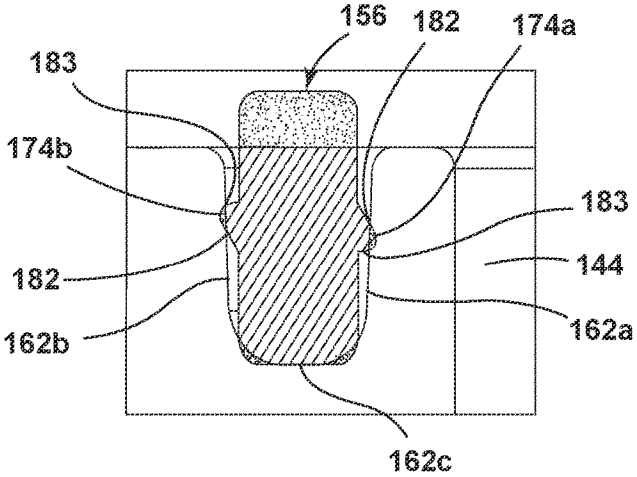
FIG. 15 is an enlarged cross-sectional view of the alternative sealing arrangement of the integrated controller assembly of FIG. 14.
Figure 18:
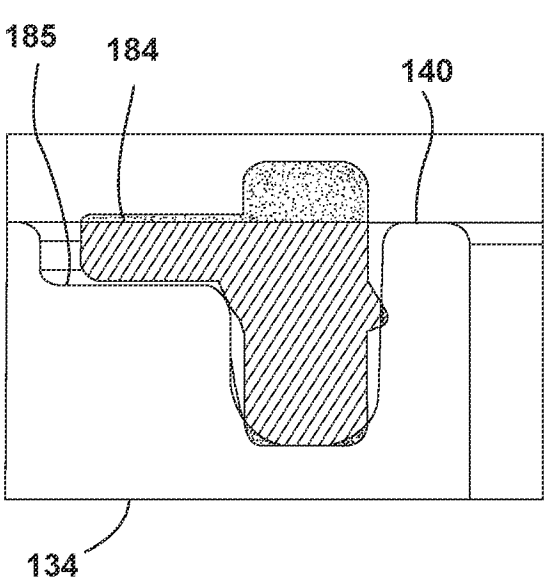
FIG. 18 is an enlarged cross-sectional view illustrating an orientation tab of the alternative sealing arrangement.
Figure 17:
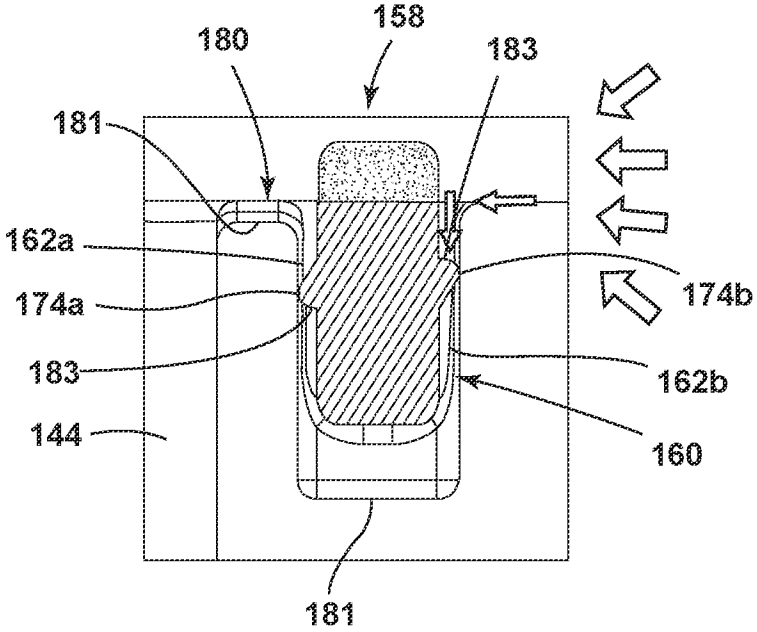
FIG. 17 is a schematic view of the alternative sealing arrangement illustrating the sealing arrangement in a closed position.

As shown particularly in FIGS. 12 and 13, the venting element 75 is movable between a closed position (FIG. 12) in which the curved lip 76 of the venting element 75 seals against the sealing surface 68 of the gland 64 and an open position (FIG. 13) in which the curved lip 76 is spaced from the sealing surface 68 to allow for communication of fluid from the housing internal chamber 44 to outside of the housing 34. The flow arrows in FIG. 12 show that when an external pressure outside of the housing 34 is greater than an internal pressure in the housing chamber 44, the venting element 75 is in the closed position and the curved lip 76 seals against the sealing surface 68 to prevent flow of fluid past the venting element 75 and prevents flow through the gland 64. On the other hand, the flow arrows in FIG. 13 show that when the internal pressure in the housing chamber 44 is greater than the external pressure outside of the housing 34, the venting element 75 is in the open position and fluid can flow in the space between the curved lip 76 and the sealing surface 68. Specifically, gas from within the internal chamber 44 flows through the vent passage 66 past the break 74*c* in the inner wing 74*a* and around the bottom surface 73*c* of the gasket body 72 to the curved lip 76. The gas pressure being greater within the vent passage than the outside pressure within the pocket 78 causes the curved lip 76 to flex away from the sealing surface 68 and in the direction of the pocket 68. The separation of the curved lip 76 from the sealing surface 68 allows the gas to flow past the curved lip 76 and out between the heat sink 54 and the outer face surface 40 of the housing 34. Once the pressure from within the internal chamber 44 is relieved and the pressure in the internal chamber is balanced with (or less than) the external pressure, the externa pressure forces the curved lip 76 back into sealing engagement with the sealing surface 68, i.e. back into the closed position. In this manner, the venting element 75 and gland 64 of the sealing arrangement 58 manually moves between open and closed position to provide facile ventilation of the internal chamber 44 of the housing 34, without the need for additional parts or additional assembly steps (and associated cost), as the sealing arrangement is provided by the gasket and corresponding groove that is otherwise necessary to seal between the housing 34 and heat sink 54.

Turning to FIGS. 14-18, in an alternative embodiment the sealing arrangement 158 comprises the wings 174*a*, 174*b* of the gasket 156 and a gland 180 including a vent passage 181 formed in the outer face surface 140 of the housing 134 adjacent the opening 146 and traversing the bottom surface 162*c* of the groove 160 in which the gasket 156 is seated. In this embodiment, the wings 174*a*, 174*b* have a triangular cross-sectional shape in a radial direction such that each wing has an angled face 182 and a flat face 183. As shown schematically by flow arrows in FIG. 16, when the pressure within the internal chamber 144 is greater than the external pressure, the force against the angled faces 182 flexes the wings 174*a*, 174*b* away from the inward surface 162*a* and outward surface 162*b* of the groove 160, respectively, moving the gasket wings 174*a*, 174*b* to an open position to allow flow of air from the internal chamber 144 through the vent passage 181 of the gland 180 and past the interface between the housing 134 and heat sink 154 to the external environment. On the other hand, as shown by flow arrows in FIG. 17 when the external pressure is greater than the pressure within the internal chamber 144, the force against the flat faces 183 forces the wings 174*a*, 174*b* into compressed engagement with the inward surface 162*a* and outward surface 162*b* of the groove 160, respectively, moving the gasket wings 174*a*, 174*b* to a closed position to seal the gland 180 and prevent flow of fluid between the internal chamber 144 and the external environment. In order to ensure proper orientation of the gasket 156 during assembly, the gasket 156 may further include a separate orientation tab 184 that fits into a corresponding receptacle 185 on the outer face surface 140 of the housing 134. As should be apparent from the various embodiments, the sealing arrangement/venting element can have a variety of shapes that can be adjusted and combined to provide venting (sealing and relief) of pressure at a desired level.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements by ordinal terms, for example "first," "second," and "third," are used for clarity, and are not to be construed as limiting the order in which the claim elements appear. Any reference to claim elements in the singular, for example, using the articles "a," "an," "the" or "said," is not to be construed as limiting the element to the singular.

The invention claimed is:

1. A sealing arrangement for an electronically commutated fluid pump, the sealing arrangement comprising:

a housing including an outer face surface and an internal chamber, the outer face surface forming a perimeter that defines an opening into the chamber;

an endless groove formed in the outer face surface, the endless groove surrounding the perimeter, the endless groove having an inward radial sealing surface, an opposite outward radial sealing surface, and a bottom axial sealing surface between the inward and outward radial sealing surfaces;

a gland formed in the outer face surface and connected to the endless groove, the gland including a vent passage and a sealing surface that defines a depression in the outer face surface of the housing, the vent passage connecting the chamber in fluid communication with the depression;

a gasket including:

an endless body having an inner side surface, an outer side surface, a bottom surface, and a top surface;

a pair of inner and outer radially extending wings, the inner wing extending from the inner side surface of the body and the outer wing extending from the outer side surface of the body; and a venting element protruding from the outer side surface of the body, the venting element including a lip, the lip extending upwardly and outwardly from the bottom surface of the body;

the gasket being received in the endless groove such that the venting element is disposed in the gland, the inner wing of the gasket engages the inward radial sealing surface of the endless groove, and the outer wing of the gasket engages the outward radial sealing surface of the endless groove;

wherein the venting element is movable between a closed position in which the lip of the venting element seals against the sealing surface of the gland and an open position in which the lip is spaced from the sealing surface to allow for communication of fluid from the housing chamber to outside of the housing;

wherein the venting element is in the closed position when an external pressure outside of the housing is greater than an internal pressure in the housing chamber, and the venting element is in the open position when the internal pressure in the housing chamber is greater than the external pressure outside of the housing.

2. The sealing arrangement of claim 1, wherein the vent passage is a groove transverse to the endless groove.

3. The sealing arrangement of claim 2, wherein the vent passage groove extends from a wall of the chamber housing through the endless groove to the sealing surface of the gland.

4. The sealing arrangement of claim 2, wherein the vent passage groove is formed in the outer face surface of the housing, the endless groove, and the sealing surface.

5. The sealing arrangement of claim 1, wherein the venting element includes a pair of sidewalls disposed at opposite ends of the lip.

6. The sealing arrangement of claim 5, wherein a pocket is formed between the lip of the venting element, the sidewalls of the venting element, and the outer side surface of the body.

7. The sealing arrangement of claim 1, wherein the venting element includes at least one rib formed on a back surface of the lip.

8. The sealing arrangement of claim 1, wherein the inner wing of the gasket has a break adjacent the venting element, and the break is aligned with the vent passage of the gland.

9. An integrated controller assembly for an electronically commutated fluid pump, the assembly comprising:

a housing including an outer face surface and an internal chamber, the outer face surface forming a perimeter that defines an opening into the chamber;

a printed circuit board received in the chamber;

electrical terminals connected to the printed circuit board and extending through the housing;

a heat sink mounted against the outer face surface of the housing and covering the opening in the housing;

an endless groove formed in the outer face surface of the housing, the endless groove surrounding the perimeter, the endless groove having an inward radial sealing surface, an opposite outward radial sealing surface, and a bottom axial sealing surface between the inward and outward radial sealing surfaces;

a gland formed in the outer face surface and connected to the endless groove, the gland including a vent passage and a sealing surface that defines a depression in the outer face surface of the housing, the vent passage connecting the chamber in fluid communication with the depression;

a gasket including:

an endless body having an inner side surface, an outer side surface, a bottom surface, and a top surface;

a pair of inner and outer radially extending wings, the inner wing extending from the inner side surface of the body and the outer wing extending from the outer side surface of the body; and a venting element protruding from the outer side surface of the body, the venting element including a lip, the lip extending upwardly and outwardly from the bottom surface of the body;

the gasket being received in the endless groove such that the venting element is disposed in the gland, the inner wing of the gasket engages the inward radial sealing surface of the endless groove, the outer wing of the gasket engages the outward radial sealing surface of the endless groove, and the top surface of the gasket engages the heat sink;

wherein the venting element is movable between a closed position in which the lip of the venting element seals against the sealing surface of the gland and an open position in which the lip is spaced from the sealing surface to allow for communication of fluid from the housing chamber to outside of the housing;

wherein the venting element is in the closed position when an external pressure outside of the housing is greater than an internal pressure in the housing chamber, and the venting element is in the open position when the internal pressure in the housing chamber is greater than the external pressure outside of the housing.

10. The assembly of claim 9, wherein the vent passage is a groove transverse to the endless groove.

11. The assembly of claim 9, wherein the venting element includes a pair of sidewalls disposed at opposite ends of the lip.

12. The assembly of claim 11, wherein a pocket is formed between the lip of the venting element, the sidewalls of the venting element, and the outer side surface of the body.

13. The assembly of claim 9, wherein the inner wing of the gasket has a break adjacent the venting element, and the break is aligned with the vent passage of the gland.

14. An electronically commutated fluid pump comprising:

a main housing;

a pumping section disposed within the main housing;

a motor disposed within the main housing and operatively connected to the pumping section; and an integrated controller assembly mounted on the main housing, the integrated controller assembly including:

a housing including an outer face surface and an internal chamber, the outer face surface forming a perimeter that defines an opening into the chamber;

a printed circuit board received in the chamber;

electrical terminals connected to the printed circuit board and extending through the housing;

a heat sink mounted against the outer face surface of the housing and covering the opening in the housing;

an endless groove formed in the outer face surface of the housing, the endless groove surrounding the perimeter, the endless groove having an inward radial sealing surface, an opposite outward radial sealing surface, and a bottom axial sealing surface between the inward and outward radial sealing surfaces;

a gland formed in the outer face surface and connected to the endless groove, the gland including a vent passage and a sealing surface that defines a depression in the outer face surface of the housing, the vent passage connecting the chamber in fluid communication with the depression;

a gasket including:

an endless body having an inner side surface, an outer side surface, a bottom surface, and a top surface;

a pair of inner and outer radially extending wings, the inner wing extending from the inner side surface of the body and the outer wing extending from the outer side surface of the body; and a venting element protruding from the outer side surface of the body, the venting element including a lip, the lip extending upwardly and outwardly from the bottom surface of the body;

the gasket being received in the endless groove such that the venting element is disposed in the gland, the inner wing of the gasket engages the inward radial sealing surface of the endless groove, the outer wing of the gasket engages the outward radial sealing surface of the endless groove, and the top surface of the gasket engages the heat sink;

wherein the venting element is movable between a closed position in which the lip of the venting element seals against the sealing surface of the gland and an open position in which the lip is spaced from the sealing surface to allow for communication of fluid from the housing chamber to outside of the housing;

wherein the venting element is in the closed position when an external pressure outside of the housing is greater than an internal pressure in the housing chamber, and the venting element is in the open position when the internal pressure in the housing chamber is greater than the external pressure outside of the housing.

15. The fluid pump of claim 14, wherein the vent passage is a groove transverse to the endless groove.

16. The fluid pump of claim 15, wherein the vent passage groove extends from a wall of the chamber housing through the endless groove to the sealing surface of the gland.

17. The fluid pump of claim 15, wherein the vent passage groove is formed in the outer face surface of the housing, the endless groove, and the sealing surface.

18. The fluid pump of claim 14, wherein the venting element includes a pair of sidewalls disposed at opposite ends of the lip.

19. The fluid pump of claim 14, wherein a pocket is formed between the lip of the venting element, the sidewalls of the venting element, and the outer side surface of the body.

20. The fluid pump of claim 14, wherein the inner wing of the gasket has a break adjacent the venting element, and the break is aligned with the vent passage of the gland.

* * * * *